US006314883B1

(12) United States Patent
Wech

(10) Patent No.: US 6,314,883 B1
(45) Date of Patent: Nov. 13, 2001

(54) APPARATUS AND METHOD FOR COMPENSATING FOR SLIP OF A PRINTING-PLATE SLEEVE

(75) Inventor: Erich Wech, Augsburg (DE)

(73) Assignee: MAN Roland Druckmaschinen AG, Offenbach am Main (DE)

( * ) Notice: Subject to any disclaimer, the term of this patent is extended or adjusted under 35 U.S.C. 154(b) by 0 days.

(21) Appl. No.: 09/449,316

(22) Filed: Nov. 24, 1999

(30) Foreign Application Priority Data

Nov. 25, 1998 (DE) ..... 198 54 343

(51) Int. Cl.[7] ..... B41F 13/12

(52) U.S. Cl. ..... 101/248; 101/481; 101/485; 33/614

(58) Field of Search ..... 33/617, 1 BB, 33/286, 613, 614, 615, 618, 619, 620, 621; 101/248, 481, 485, 486, DIG. 36

(56) References Cited

U.S. PATENT DOCUMENTS

| | | | | |
|---|---|---|---|---|
| 3,915,090 | | 10/1975 | Horst et al. | 101/426 |
| 3,997,828 | * | 12/1976 | Bottcher et al. | 101/485 |
| 5,127,324 | | 7/1992 | Palmatier et al. | 101/248 |
| 5,239,924 | * | 8/1993 | Wallmann et al. | 101/486 |
| 5,367,953 | * | 11/1994 | Yamashita et al. | 33/619 |
| 5,488,781 | * | 2/1996 | Van Der Horst | 33/617 |
| 5,492,062 | * | 2/1996 | Harris et al. | 101/486 |
| 5,649,484 | * | 7/1997 | Broghammer et al. | 33/614 |
| 6,101,945 | * | 8/2000 | Hara et al. | 33/621 |

FOREIGN PATENT DOCUMENTS

| | | | |
|---|---|---|---|
| 31 36 703 C1 | 11/1982 | (DE) | B41F/33/14 |
| 35 43 704 C2 | 6/1993 | (DE) | B41F/13/08 |
| 44 12 873 A1 | 11/1994 | (DE) | B41F/27/06 |
| 44 12 873 C2 | 6/1995 | (DE) | B41F/27/06 |
| 44 01 269 A1 | 7/1995 | (DE) | B41F/33/14 |
| 60122153 | 6/1985 | (JP) | B41F/13/12 |
| 09174819A | 8/1987 | (JP) | G05D/3/12 |

OTHER PUBLICATIONS

Siemens–Registerregelung; Von Karl Fischer Und Hildegard Schaufler; Feb., 1995.

* cited by examiner

*Primary Examiner*—Christoper W. Fulton
(74) *Attorney, Agent, or Firm*—Cohen, Pontani, Lieberman & Pavane

(57) ABSTRACT

In order to compensate for slippage of a printing-plate sleeve on the plate cylinder of a printing unit having its own motor, a first reference point for the position of the printing plate is sensed by a sensor. The first reference point is then compared with the position of a reference printing-plate sleeve of a reference printing unit. A motor during the printing unit is then readjusted when there is a determined deviation from the desired position.

10 Claims, 1 Drawing Sheet

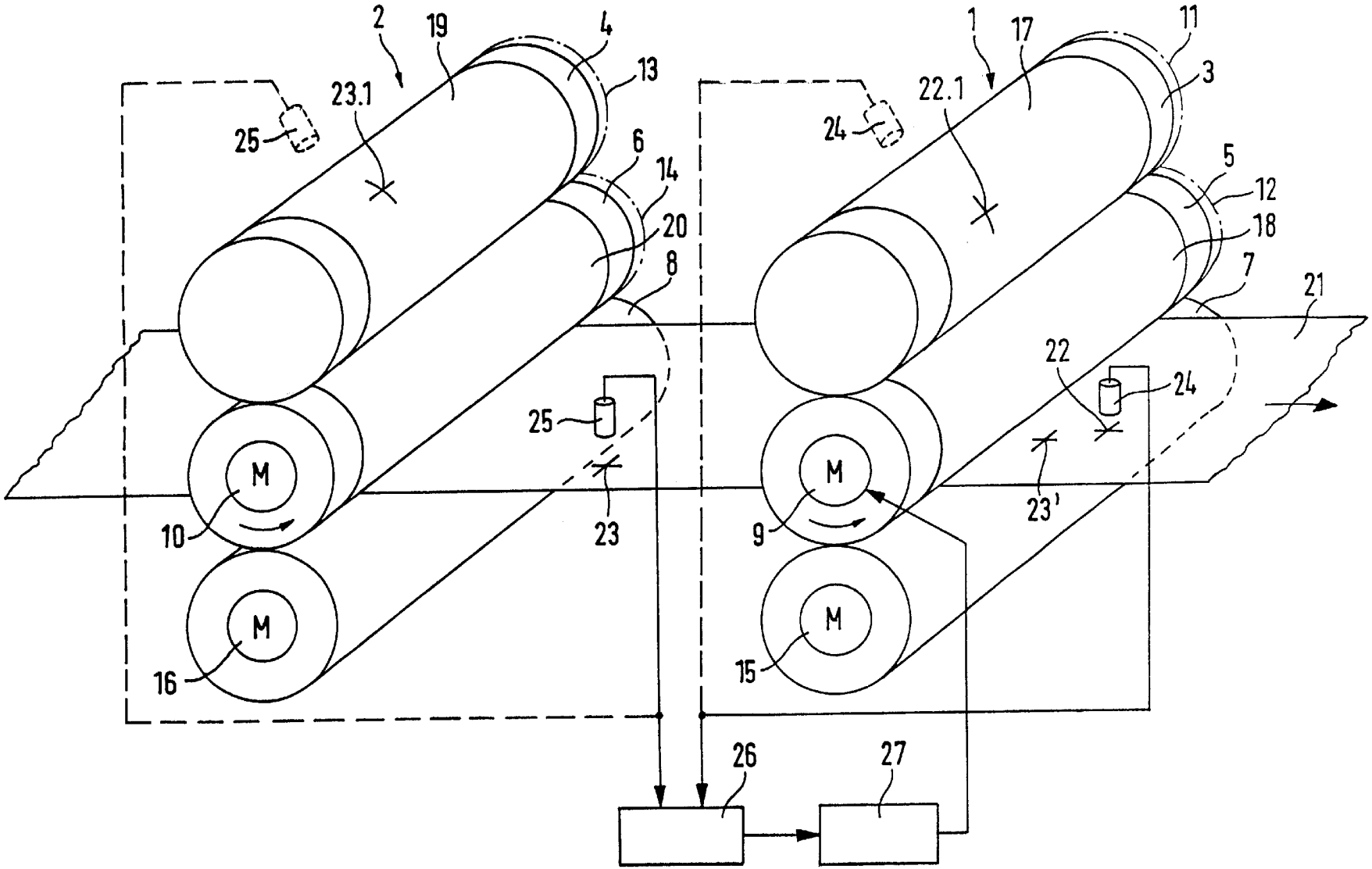
1
2
3
4
5
6
7
8
9
10
11
12
13
14
15
16
17
18
19
20
21
22
22.1
23
23'
23.1
24
25
26
27
M
M
M
M

APPARATUS AND METHOD FOR COMPENSATING FOR SLIP OF A PRINTING-PLATE SLEEVE

BACKGROUND OF THE INVENTION

1. Field of the Invention

The invention relates to printing machines, and more particularly to an apparatus and a method for slip compensation of a printing-plate sleeve on the plate cylinder of a printing unit.

2. Description of the Related Art

DE 35 43 704 C2 shows a printing-plate sleeve which is secured onto the plate cylinder by means of a shrink fit. In a force-fitting connection of this type there is the risk that the printing-plate sleeve will rotate in the circumferential direction if the shrink fit is not sufficiently strong.

According to DE 44 12 873 A1, the printing-plate sleeve is provided on its inner wall with a guide element, for example a web, which extends in the direction of the longitudinal axis of the sleeve. When the sleeve is mounted, the guide element projects into a groove in the plate cylinder. In this way, the printing-plate sleeve is positively secured against rotation. However, this type of safeguard requires a special shape of the sleeves.

SUMMARY OF THE INVENTION

An object of the invention is to provide an apparatus and a method which counteracts the rotation of a printing-plate sleeve on a plate cylinder without requiring a positive fit between the two.

This and other objects of the present invention are achieved by virtue of the individual drive of a printing unit, a rotatable printing-plate sleeve which can be rotated back, together with the plate cylinder, into a desired position. This therefore provides a way to mount printing-form sleeves on plate cylinders with a force fit, without running the risk of rejects or increased costs in terms of quality arising from slippage of the plate sleeves. The printing-plate sleeves can be produced cost-effectively.

The various features of novelty which characterize the invention are pointed out with particularity in the claims annexed to and forming a part of the disclosure. For a better understanding of the invention, its operating advantages, and specific objects attained by its use, reference should be had to the drawing and descriptive matter in which there are illustrated and described preferred embodiments of the invention.

BRIEF DESCRIPTION OF THE DRAWINGS

The invention is to be explained in more detail below using an exemplary embodiment. The single drawing is a schematic representation of two printing units having an apparatus for slip compensation of a printing-plate sleeve.

DETAILED DESCRIPTION OF THE PRESENTLY PREFERRED EMBODIMENTS

The figure shows two printing units 1, 2 of a web-fed rotary printing machine. Each printing unit 1, 2 contains a plate cylinder 3, 4, a transfer cylinder 5, 6 and an impression cylinder 7, 8. These printing-unit cylinders 3 to 8 are mounted on one side in one side wall or on both sides in two side walls (neither illustrated). Each plate cylinder 3, 4 is driven by its own motor (electric motor) 9, 10, the drive in the exemplary embodiment being provided indirectly via the transfer cylinders 5, 6. For this purpose, the motors 9, 10 drive the transfer cylinders 5, 6 and the latter provide the drive to the plate cylinders 3, 4 by means of spur gears 11 to 14 on the journals of these cylinders. Likewise, motors could drive the plate cylinders 3, 4, and the latter would drive the transfer cylinders 5, 6 via spur gears. It is also possible for each plate and transfer cylinder 3 to 6 to be equipped with its own motor, dispensing with the spur gears 11 to 14. The impression cylinders 7, 8 are also each driven by their own motor 15, 16, by way of example. Instead of this, the impression cylinders 7, 8 could also have a drive connection to the transfer cylinders 5, 6 by means of spur gears, dispensing with the motors 15, 16.

The plate cylinder 3 of the printing unit 1 carries a printing-plate sleeve 17, which is fixed to the latter with a force fit. Possibilities for changing a printing-form sleeve positioned in this way with a press fit are shown in the aforementioned DE 35 43 704 C2. The transfer cylinder 5 has a rubber blanket sleeve 18. Similarly to the printing unit 1, the plate cylinder 4 carries a reference printing-plate sleeve 19, and the transfer cylinder 6 carries a rubber blanket sleeve 20.

In each case, the respective transfer and impression cylinders 5, 7 and 6, 8 of a printing unit 1, 2 can be thrown onto each other in order to print a web 21 led through between them. During printing, the printing unit 1 prints a first web point 22 and the printing unit 2 prints a second web point 23 onto the web 21. The first web point 22 is sensed by a first sensor 24 and the second web point 23 is sensed by a second sensor 25. Both sensors 24, 25 are connected to a comparison device 26, the output of which is connected to the motor 9 of the printing unit 1 via a computer/motor control system 27.

The first web point 22 is the impression of a first plate point 22.1 on the printing-plate sleeve 17. The second web point 23 is the impression of a second plate point 23.1 on the reference printing-plate sleeve 19 of the plate cylinder 4. The first web point 22 is thus a first reference point for the position of the printing-plate sleeve 17 in the circumferential direction of the plate cylinder 3. This position must have a fixed relationship with respect to the position of the reference printing-plate sleeve 19, which position is embodied as a second reference point by the second web point 23. The respective sensors 24, 25 sensing the web points 22, 23 indicate the passage of the first and second web points 22, 23 past the respective sensor 24, 25 by means of electric signals. The signals are evaluated in the comparison device 26. If the printing-plate sleeve 17 rotates with respect to the plate cylinder 3, that is to say if there is slippage of the printing-plate sleeve 17, a deviation from a desired position is determined in comparison device 26. Upon detection of a deviation, comparison device 26 outputs an appropriate signal to the computer/motor control system 27 to readjust the motor 9. If the printing-plate sleeve 17 slips in the direction of rotation of the plate cylinder 3, the rotational speed of the motor 9 is reduced. If, on the other hand, the printing-plate sleeve 17 slips in the direction opposite to the direction of rotation of the plate cylinder 3, the rotational speed of the motor 9 is increased until the printing-plate sleeve 17 again assumes the desired rotational position in relation to the reference printing-plate sleeve 19.

A point on the printing-plate sleeve 17 itself can also be used as the first reference point for the position of the printing-plate sleeve 17 on the plate cylinder 3, for example the first plate point 22.1. In order to sense first plate point 22.1, the sensor 24 has to be oriented towards the plate cylinder 3, as indicated in dashed lines in the FIGURE. The evaluation in comparison device 26 is performed in a manner similar to the evaluation when sensing the first web point 22, and if a positional deviation of the printing-plate sleeve 17 is detected, the motor 9 is readjusted appropriately.

A point on the reference printing-plate sleeve 19 itself can also be used as the second reference point for the position of the latter, for example the second plate point 23.1 In order to sense the second plate point 23.1, the sensor 25 then has to be oriented towards the plate cylinder 4 carrying the reference printing-plate sleeve 19. The evaluation is carried out in a manner similar to the evaluation when sensing the second web point 23.

It is advantageous to be able to use, as the second reference point, a color register mark or a cut-off register mark which, when printed onto the web as a second web point 23 or on the printing plate as a second plate point 23. 1, is sensed by the sensor 25. In this case, the socalled standard color, with respect to which the other colors are brought into register, is advantageously used as the color register mark. The second reference point 23, 23.1 advantageously also has a fixed relationship with the cut-off register. It is also possible for the first web point 22 and the second web point 23' to be sensed jointly by one sensor, for example the sensor 24. The second web point 23' being a point printed adjacent to the first web point 24, chronologically before the second web point 23 in the exemplary embodiment.

The printing units 1, 2 of the exemplary embodiment operate in accordance with an indirect printing process, for example in offset printing. The apparatus can also be used in other indirect printing processes and also in direct printing processes. In the printing units 1, 2, it is also possible for the impression cylinder 15, 16 to be replaced in each case by a printing unit containing a plate cylinder and a transfer cylinder. In the case of such double printing units, operating on the rubber-to-rubber principle, the apparatus for compensating for slip can be used both for the upper and the lower printing unit.

The invention is not limited by the embodiments described above which are presented as examples only but can be modified in various ways within the scope of protection defined by the appended patent claims.

I claim:

1. An apparatus for compensating for slippage of a first printing plate sleeve on a first plate cylinder of a printing unit of a web fed rotary printing machine relative to a reference printing plate sleeve on a reference plate cylinder of a reference printing unit of the web fed rotary printing machine, the first plate cylinder being driven by a motor and the first plate cylinder and the reference plate cylinder arranged for printing on a web which passes through the web fed printing machine, the apparatus comprising:

a first sensor sensing a first reference point on one of the first printing plate sleeve and the web, the first reference point representing a position of the first printing, plate sleeve in a circumferential direction;

a reference sensor sensing a second reference point on one of the reference printing plate sleeve and the web, the second reference point representing a position of the printing plate sleeve of the reference printing unit; and a comparison device connected to said first sensor and said reference sensor and the motor, said comparison device evaluating position indicating signals from said first and reference sensors and adjusting the motor to compensate for determined deviations in the position of the printing plate sleeve from a desired position.

2. The apparatus in accordance with claim 1, wherein said first reference point is a first plate point on the printing plate sleeve, said first sensor being positioned towards the plate cylinder of the first printing unit in order to detect said first reference point.

3. The apparatus in accordance with claim 1, wherein said first reference point comprises a first web point printed onto the web by the printing plate sleeve, said first sensor being directed at the web in order to detect said first web point.

4. The apparatus in accordance with claim 1, wherein second reference point comprises a second plate point on the reference printing plate sleeve, said reference sensor being direct toward the reference plate cylinder of the reference printing unit in order to detect said second reference point.

5. The apparatus in accordance with claim 1, wherein said second reference point comprises a second web point printed onto the web by the reference printing plate sleeve, said reference sensor being directed toward the web in order to detect said second web point.

6. The apparatus in accordance with claim 4, wherein said second reference point comprises a color register mark.

7. The apparatus in accordance with claim 4, wherein said second reference point comprises a cut-off register mark.

8. The apparatus in accordance with claim 5, wherein said second reference point comprises a color register mark.

9. The apparatus in accordance with claim 5, wherein said second reference point comprises a cut-off register mark.

10. A method for compensating for slippage of a printing plate sleeve on a plate cylinder of a printing unit of a web-fed rotary printing machine comprising the steps of:

driving the plate cylinder of the printing unit with a motor;

generating a first signal representative of a position of the printing plate sleeve;

generating a second signal representative of a position of a reference printing plate sleeve of a reference printing unit;

determining deviations between the position of the printing plate sleeve with respect to a desired position by comparing the first and second generated signals; and adjusting the motor such that the plate cylinder together with the printing plate sleeve is one of accelerated and retarded in a direction opposite to a direction of determined slippage.

* * * * *